United States Patent [19]

Yamane et al.

[11] Patent Number: 4,974,513

[45] Date of Patent: Dec. 4, 1990

[54] THERMAL DIRECT MASTER

[75] Inventors: Shiro Yamane, Susono; Fumiaki Arai, Mishima, both of Japan

[73] Assignee: Ricoh Company, Ltd., Tokyo, Japan

[21] Appl. No.: 379,365

[22] Filed: Jul. 13, 1989

[30] Foreign Application Priority Data

Sep. 1, 1988 [JP] Japan ..... 63-219960
May 8, 1989 [JP] Japan ..... 1-115392

[51] Int. Cl.[5] ..... B41N 1/14

[52] U.S. Cl. ..... 101/453; 101/460; 101/467

[58] Field of Search ..... 101/467, 460, 453

[56] References Cited

FOREIGN PATENT DOCUMENTS 56607 5/1977 Japan ..... 101/467
1182989 8/1986 Japan ..... 101/467
2267194 11/1987 Japan ..... 101/453
3116891 5/1988 Japan ..... 101/453
3116892 5/1988 Japan ..... 101/453

*Primary Examiner*—Clifford D. Crowder
*Attorney, Agent, or Firm*—Oblon, Spivak, McClelland, Maier & Neustadt

[57] ABSTRACT

A thermal direct master for lithography, which comprises a water-resisting substrate and a thermosensitive recording layer formed thereon, which comprises as the main components an inorganic pigment, a binder agent, a thermofusible material and a hydrophilic modified silicon oil. The above-mentioned hydrophilic modified silicon oil may be selected from the group consisting of a carboxyl-modified silicone oil, an alkyl higher alcohol eseter modified silicone oil, an alcohol-modified silicone oil, polyether-modified silicon oil, and an α-olefin modified silicone oil.

10 Claims, No Drawings

THERMAL DIRECT MASTER

BACKGROUND OF THE INVENTION

1. Field of the Invention

The present invention relates to a thermal direct master for litho printing, which can be prepared by thermalprinting.

2. Discussion of Background

A Pre-Sensitized (PS) plate, obtained by coating a photosensitive resin on the surface of an aluminum plate, and a master plate comprising zinc oxide, manufactured by electrophotography, are conventionally used as a master for litho printing.

However, the above-mentioned conventional masters have some shortcomings. For example, the PS plate has photosensitive properties, and thus it must be handled and stored with the utmost care. Furthermore, the original pattern cannot be directly formed on the master, requiring the use of a Lith film in the course of manufacturing the PS master. The process for treating the Lith film is complicated and some chemicals for treating the Lith film cause environmental pollution.

In the case where the master plate is manufactured by electrophotography, an expensive electrophotographic master-making machine is required, in which a series of complicated processes such as exposure, development and image fixing are performed.

In order to eliminate the above-mentioned shortcomings of the conventional masters for litho printing, a method of making a thermal direct master by thermally printing an original pattern on a master by use of a thermal head, was proposed as disclosed in Japanese Laid-Open Patent Applications Nos. 59-174395, 58-199153, 62-164049 and 62-164596. This thermal direct master is constructed in such a manner that a thermosensitive recording layer comprising an inorganic pigment, a binder agent and a thermofusible material such as wax is formed on a water-resisting substrate.

However, the thermal direct masters disclosed in the Japanese Laid-Open Patent Applications Nos. 59-174395 and 58-199153 have a drawback in that since the thermosensitive recording layer of the master comprises a hydrophilic resin such as polyvinyl alcohol (PVA) or acetoacetylated polyvinyl alcohol, ink cannot be deposited satisfactorily on the master due to the lack of lipophilic properties in the thermosensitive recording layer. Accordingly, the above-mentioned thermal direct master yields printed images with a low image density, and this may be accompanied by unevenness in the images.

The thermal direct masters disclosed in Japanese Laid-Open Patent Applications Nos. 62-164049 and 62-164596 also have a shortcoming in that their manufacturing process is complicated. The thermosensitive recording layer of each master comprises a polymer having active hydrogen which reacts with blocked isocyanate and isocyanate and thus an extra clearing step is essential, in which the reactive polymer attached to non-image areas of the thermal direct master, is eliminated after image-forming is completed on the master.

SUMMARY OF THE INVENTION

Accordingly, a first object of the present invention is to provide a thermal direct master for use in litho printing, capable of forming uniform clear images thereon with excellent image quality and resolution, free from the undesirable phenomenon of the master sticking to a thermal head in the course of thermal-printing.

A second object of the present invention is to provide a thermal direct master for litho printing, which can be easily made by thermal-printing using the thermal head, without requiring any complicated processes such as exposure, development and image fixing.

The first and second objects of the present invention can be attained using a thermal direct master comprising a water-resisting substrate and a thermosensitive recording layer formed thereon, which comprises a hydrophilic modified silicone oil.

DETAILED DESCRIPTION OF THE PREFERRED EMBODIMENTS

According to the present invention, the thermal direct master for litho printing is constructed in such a manner that a thermosensitive recording layer comprising as the main components an inorganic pigment, a binder agent, a thermofusible material and at least one hydrophilic modified silicone oil, is formed on a water-resisting substrate. The hydrophilic modified silicone oil for use in the present invention is prepared by modifying the silicone oil by use of hydrophilic materials, such as alcohol polyether.

Preferable examples of the hydrophilic modified silicone oil for use in the present invention are carboxyl-modified silicone oil, alkyl higher alcohol ester modified silicone oil, alcohol-modified silicone oil, polyethermodified silicone oil and c-olefin modified silicone oil.

The above-mentioned carboxyl-modified silicone oil, having free carboxyl groups in a molecule thereof, is represented by the following structural formula:

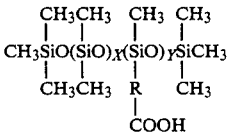

wherein x and y each represent polymerization degree; and R represents a bivalent hydrocarbon group.

As a commercially available carboxyl-modified silicone oil, "SF8418" (Trademark), made by Toray Silicone Co., Ltd., can be employed.

The aforementioned alkyl higher alcohol ester modified silicone oil is represented by the following structural formula:

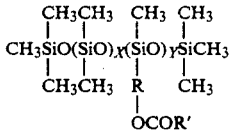

wherein x and y each represent polymerization degree; R represents a bivalent hydrocarbon group; and R' represents a monovalent hydrocarbon group.

As a commercially available alkyl higher alcohol ester modified silicone oil, "SF8422" (Trademark), made by Toray Silicone Co., Ltd., can be employed.

The aforementioned alcohol-modified silicone oil is represented by any of the following structural formulas:

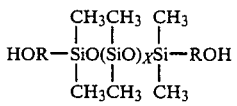

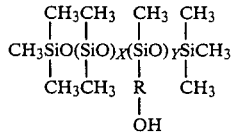

wherein x and y each represent polymerization degree; and R represents a bivalent aliphatic hydrocarbon group.

As commercially available alcohol modified silicone oils, "SF8427" and "SF8428" (Trademark), made by Toray Silicone Co., Ltd., and "KF851" and "X-22-801" (Trademark), made by Shin-Etsu Chemical Co., Ltd., can be employed. For example, "SF8427" and "SF8428" made by Toray Silicone Co., Ltd., are obtained as follows:

Both of them are based on the polydimethylsiloxane structure.

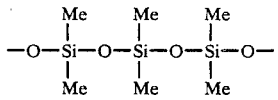

They can be modified by replacing with alcohol, some of the methyl groups serving as an organofunctional group in the polydimethylsiloxane as follows:

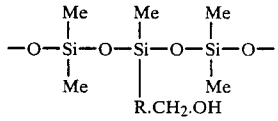

"SF8427" contains primary alcohols as shown in the following formula and is water-soluble.

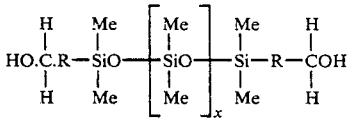

[SF8427]

"SF8428" contains secondary alcohols as shown in the following formula and is not water-soluble.

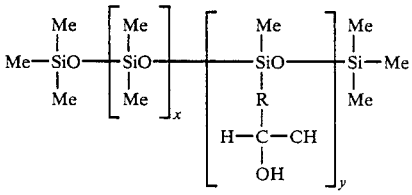

[SF8428]

The aforementioned polyether-modified silicone oil is represented by the following structural formula:

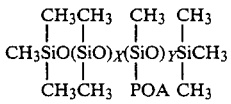

wherein x and y each represent polymerization degree; and POA represents polyoxyethylene polyoxypropylene glycol ether residue.

As commercially available polyether-modified silicone oils, "SHF747" and "ST102PA" (Trademark), made by Toray Silicone Co., Ltd., and "KF351" (Trademark), made by Shin-Etsu Chemical Co., Ltd., can be employed.

The polyether-modified silicone oil is obtained through the introduction of hydroxyalkylene groups as follows:

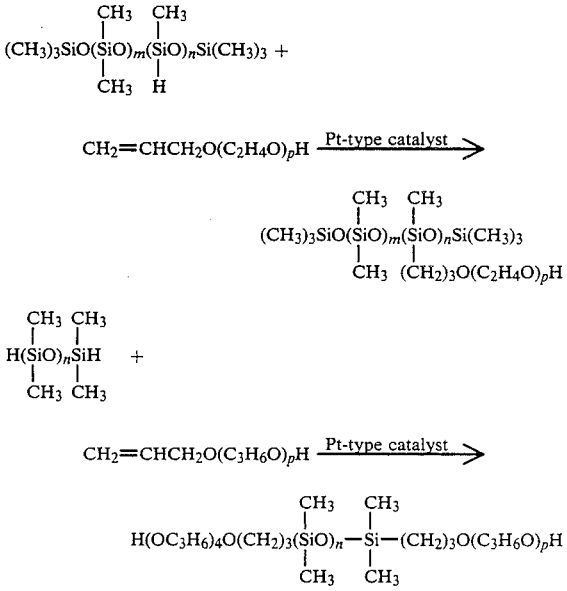

The aforementioned α-olefin modified silicone oil is represented by the following structural formula:

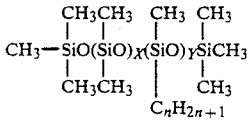

wherein x and y each represent polymerization degree; and $C_nH_{2n+1}$ represents a hydrogenated α-olefin addition moiety.

As commercially available α-olefion modified silicone oils, "KF412", "KF413" and "KF414" (Trademark), made by Shin-Etsu Chemical Co., Ltd., can be employed.

The α-olefin modified silicone oil is obtained through the introduction of a long-chain alkyl group as follows:

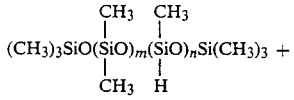

-continued

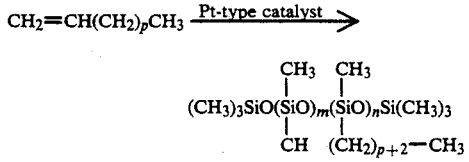

The thermal direct master according to the present invention, contains the above-mentioned hydrophilic modified silicone oil uniformly dispersed in the thermosensitive recording layer, together with an inorganic pigment, a binder agent and a thermofusible material, so that the hydrophilic modified silicone oil shows appropriate lubricant characteristics and releases easily from the thermal head. Accordingly, the sticking of the thermal direct master to the thermal head can be prevented and high-quality images can be formed on the thermal direct master. The thermal direct master according to the present invention can thus form high-quality printed images, with excellent resolution.

As the inorganic pigment for use in the thermosensitive recording layer, clay, silica, zinc oxide, titanium oxide, aluminum oxide, calcium carbonate, barium carbonate and barium sulfate can be employed. Among the above inorganic pigments, zinc oxide is the most preferable from the viewpoint of thermosensitivity.

As the binder agent for use in the thermosensitive recording layer, the binder agents having a ring and ball softening point of 150° C. or less are preferable.

Preferable examples of the above-mentioned binder agents are styrene resins such as polystyrene, styrene-acrylic acid ester copolymer and poly-t-butylstyrene; low-melting polyamide resin; polyacrylic acid ester; polymethacrylic acid ester; acrylic acid ester-methacrylic acid ester copolymer; polyester resin; ethylene-vinyl acetate copolymer; vinyl vinylidene chloride resin; butyral resin; acetal resin; and polyvinyl toluene. Among these binder agents, polystyrene, styrene-acrylic acid ester copolymer, polyacrylic acid ester, polymethacrylic acid ester, acrylic acid ester - methacrylic acid ester copolymer and low-melting polyamide are more preferable because they can impart sufficient lipophilic nature to the surface of the thermal direct master. These binder agents can be used alone or in combination.

Preferable thermofusible materials for use in the thermo-sensitive recording layer have a melting point of 50° C. to 200° C. Examples of the preferable thermofusible materials are waxes such as carnauba wax, microcrystalline wax, paraffin wax, ceresin wax, montan wax, candelilla wax, shellac wax, insect wax, beeswax, Japan wax and low molecular weight polyethylene; higher fatty acids such as stearic acid and palmitic acid and esters, amides and higher alcohols thereof; polyols of higher fatty acid such as polyethylene glycol stearate; and polyols of higher alkyl ether such as polyethylene glycol stearyl ether.

It is preferable that the ratio by weight of the inorganic pigment to the binder agent in the thermosensitive recording layer of the thermal direct master according to the present invention be in the range of (0.5:1) to (10:1), more preferably in the range of (1:1) to (5:1). Within the above-mentioned range, the background of printed images obtained by the thermal direct master according to the present invention are not smeared with ink, because the thermo-sensitive recording layer has sufficient hydrophilic nature, and in addition, the density and uniformity of the printed images are not deteriorated because the pattern formed on the thermal direct master is sufficiently lipophilic in nature.

It is preferable that the amount of the thermofusible material contained in the thermosensitive recording layer be in the range of 0.1 to 20 wt. % of the total amount of the inorganic pigment and the binder agent, in order to balance the lipophilic and hydrophilic properties of the thermosensitive recording layer of the thermal direct master. Within the above-mentioned range, the thermal direct master according to the present invention can yield a printed image with sufficient density, without any smearing of ink on the background.

It is preferable that the amount of hydrophilic modified silicone oil for use in the present invention be in the range of 0.1 to 20 wt. % of the total amount of inorganic pigment and binder agent. Within this range, uniform images having excellent resolution can be formed on the thermal direct master because the undesirable sticking phenomenon of the master to the thermal head can be effectively prevented, and the backgrounds of the printed sheets are not smeared with ink.

In addition to the above-mentioned components, a dispersing agent may be added to the thermosensitive recording layer coating liquid to improve the dispersibility thereof. Examples of dispersing agents for use in the present invention are metallic salts of naphthenic acid, metallic salts of higher fatty acid such as stearic acid, cationic surface active agents, nonionic surface active agents and anionic surface active agents. It is preferable that the amount of the dispersing agent for use in the present invention be 10 wt. % or less of the total amount of the solid components contained in the thermosensitive recording layer coating liquid.

Examples of the water-resisting substrate include a sheet of paper wetted by melamine-formaldehyde resin, and urea-formaldehyde resin, a synthetic resin film such as polyethylene terephthalate, and a sheet of metal-deposited paper such as aluminum-deposited paper.

The thermal direct master according to the present invention can be obtained as follows:

A mixture of the above-mentioned inorganic pigment, binder agent, hot-melt material and hydrophilic modified silicone oil, and the dispersing agent when necessary, is dispersed in an appropriate solvent such as toluene by use of a dispersing apparatus such as a ball mill, attritor, homogenizer, grain mill and sand mill to form a thermosensitive recording layer coating liquid. The thus obtained thermosensitive recording layer coating liquid is coated on the water-resisting substrate by a wire bar and a roll coater in a deposition amount of 5 to 30 g/m$^2$ on a dry basis and then dried, so that a thermosensitive recording layer is formed on the water-resisting substrate.

When the thermal direct master according to the present invention is subjected to thermal printing by use of a thermal printing apparatus, for example, a thermosensitive facsimile apparatus equipped with a line-type thermal head, the thermofusible material and the binder agent contained in the thermosensitive recording layer are fused under the application of heat to the thermally printed areas. An original pattern is thus formed on the thermal direct master, and this pattern is sufficiently lipophilic to accept ink. In the course of thermal printing, sticking can be prevented due to the hydrophilic modified silicone oil contained in the thermosensitive recording layer. The areas which are not thermally printed are covered with the hydrophilic inorganic pigment. After the original pattern for printing is completely formed on the thermal direct master by thermal printing, the thermal direct master is subjected to desensitization by dipping in an etching solution, such as a weak acidic solution of about pH 5, and rubbing the surface of the master with a sponge roller to form a desensitization film. After this procedure, the thermal direct master according to the present invention is then ready for printing.

Other features of the invention will become apparent in the course of the following description of exemplary embodiments, which are given for illustration of the invention and are not intended to be limiting thereof.

EXAMPLE 1

On a sheet of high quality wet strength paper having a basis weight of 90 g/m$^2$, an undercoat layer comprising a mixture of polyvinyl alcohol and melamine was formed.

A mixture of the following components was dispersed in an attritor for 40 minutes, so that a thermosensitive recording layer coating liquid with a solid component of 40 wt. % was prepared.

| | Parts by Weight |
|---|---|
| Zinc oxide | 50 |
| Acrylic resin (Trademark "Dianal LR689" made by Mitsubishi Rayon Engineering Co., Ltd.) | 20 |
| 10% stearic acid of a mixed solution of isopropyl alcohol and toluene (75:25) | 10 |
| Alcohol-modified silicone oil (Trademark "SF8428" made by Toray Silicone Co., Ltd.) | 1 |
| Toluene | 70 |

The thus prepared thermosensitive recording layer coating liquid was coated in a deposition amount of 15 g/m$^2$ on a dry basis on the above-mentioned undercoat layer to form a thermosensitive recording layer, and then the coated surface of the thermosensitive recording layer was subjected to calendering, whereby a thermal direct master No. 1 according to the present invention was obtained.

An original was read by an original-shift type line-scanning Charge Coupled Device (CCD). The original pattern was written using a commercially available thermal printing apparatus equipped with a line-type thermal head with a recording image density of 15.7 dots/mm under the following conditions:

| | |
|---|---|
| Line speed | 4.2 ms/l |
| Applied electrical power | 0.20 W/dot |
| Pulse width | 900 μs |
| Resistance of thermal head | 2429 Ω |

The original pattern was reproduced on the thermal direct master, without any abnormality due to sticking.

The thus obtained thermal direct master according to the present invention was incorporated into a commercially available offset printing apparatus (Trademark "AP3700" made by Ricoh Company Ltd.) including an etching mechanism. As a result of the printing, the thermal direct master according to the present invention yielded 1,000 sheets or more of clear print with excellent resolution, free from ink deposition on the background. The image density of the prints ranged from 1.00 to 1.15.

EXAMPLE 2

On a sheet of high quality wet strength paper having a basis weight of 90 g/m$^2$, an undercoat layer comprising a mixture of polyvinyl alcohol melamine was formed.

A mixture of the following components was dispersed in an attritor for 40 minutes, so that a thermosensitive recording layer coating liquid with a solid component of 40 wt. % was prepared.

| | Parts by Weight |
|---|---|
| Zinc oxide | 50 |
| Low molecular weight polystyrene (Trademark "Piccolastic A-75" made by Esso Sekiyu K.K.) | 33 |
| Palmitic acid | 10 |
| Polyether-modified silicone oil (Trademark "ST102PA" made by Toray Silicone Co., Ltd.) | 5 |
| Toluene | 70 |

The thus prepared thermosensitive recording layer coating liquid was coated in a deposition amount of 15 g/m$^2$ on a dry basis on the above undercoat layer to form a thermosensitive recording layer. The coated surface of the thermosensitive recording layer was then subjected to calendering, whereby a thermal direct master No. 2 according to the present invention was obtained.

The thermal-printing was performed in the same manner as in Example 1, so that the original pattern was accurately reproduced on the thermal direct master, without any abnormality due to sticking.

The thus obtained thermal direct master according to the present invention was incorporated into a commercially available offset printing apparatus (Trademark "AP3700" made by Ricoh Company Ltd.) including an etching device. As a result of the printing, the thermal direct master according to the present invention yielded 1,000 sheets or more of clear print with excellent resolution, free from ink deposition on the background. The image density of the prints ranged from 1.02 to 1.05.

EXAMPLE 3

Example 1 was repeated except that the alcohol-modified silicone oil in the thermosensitive recording layer coating liquid employed in Example 1 was replaced by a carboxymodified silicone oil, "SF8418" (Trademark) made by Toray Silicone Co., Ltd., whereby a thermal direct master No. 3 according to the present invention was obtained.

The thermal-printing was performed in the same manner as in Example 1, so that the original pattern was accurately reproduced on the thermal direct master, without any abnormality due to sticking.

The thus obtained thermal direct master according to the present invention was incorporated into a commercially available offset printing apparatus (Trademark "AP3700" made by Ricoh Company Ltd.) having an etching device. As a result of the printing, the thermal direct master according to the present invention yielded 1,000 sheets or more of clear print with excellent resolution, free from ink deposition on the background. The density of the printed images ranged from 1.01 to 1.05.

EXAMPLE 4

Example 1 was repeated except that the alcohol-modified silicone oil in the thermosensitive recording layer coating liquid employed in Example 1 was replaced by an alkyl higher alcohol ester modified silicone oil, "SF8422" (Trademark) made by Toray Silicone Co., Ltd., whereby a thermal direct master No. 4 according to the present invention was obtained.

The thermal-printing was performed in the same manner as in Example 1, so that the original pattern was accurately reproduced on the thermal direct master, without any abnormality due to sticking.

The thus obtained thermal direct master according to the present invention was incorporated into a commercially available offset printing apparatus (Trademark "AP3700" made by Ricoh Company Ltd.) including an etching device. As a result of the printing, the thermal direct master according to the present invention yielded 1,000 sheets or more of clear print with excellent resolution, free from ink deposition on the background. The density of the printed images ranged from 1.07 to 1.10.

EXAMPLE 5

Example 1 was repeated except that the alcohol-modified silicone oil in the thermosensitive recording layer coating liquid employed in Example 1 was replaced by an α-olefin modified silicone oil, "KF412" (Trademark) made by Shin-Etsu Chemical Co., Ltd., whereby a thermal direct master No. 5 according to the present invention was obtained.

The thermal-printing was performed in the same manner as in Example 1, so that the original pattern was accurately reproduced on the thermal direct master, without any abnormality due to sticking.

The thus obtained thermal direct master according to the present invention was incorporated into a commercially available offset printing apparatus (Trademark "AP3700" made by Ricoh Company Ltd.) including an etching device. As a result of the printing, the thermal direct master according to the present invention yielded 1,000 sheets or more of clear print with excellent resolution, free from ink deposition on the background. The density of printed images ranged from 1.05 to 1.12.

COMPARATIVE EXAMPLE 1

Example 1 was repeated except that the alcohol-modified silicone oil in the thermosensitive recording layer coating liquid employed in Example 1 was replaced by a conventional silicone oil (dimethyl polysiloxane), whereby a comparative thermal direct master No. 1 was obtained.

When the thermal-printing was performed in the same manner as in Example 1, sticking of the thermal direct master to the thermal head occurred.

The thus obtained comparative thermal direct master was incorporated into a commercially available offset printing apparatus (Trademark "AP3700" made by Ricoh Company Ltd.) having an etching device. As a result of the printing, the printed sheets were considerably smeared with ink.

The results of Examples 1 through 5 and Comparative Example 1 are given in Table 1.

TABLE 1

| Example No. | (*) Sticking Problem | (**) Resolution | Blur in Images | Deposition of ink on Background |
|---|---|---|---|---|
| 1 | o | 6 lines/mm | nothing until 1000 sheets | nothing until 1000 sheets |
| 2 | o | 6 lines/mm | same as the above | same as the above |
| 3 | o | 6 lines/mm | same as the above | same as the above |
| 4 | o | 6 lines/mm | same as the above | same as the above |
| 5 | o | 6 lines/mm | same as the above | same as the above |
| Comp. Exa. 1 | x | 3 lines/mm | same as the above | Observed on the 300th sheet |

(*)Sticking problem was assessed by the presence of abnormality in the printed images per horizontal line. o — normal x — much abnormality
(**)Resolution was assessed by the number of horizontal lines for a distance of 1 mm, which were observed using an optical microscope.

With respect to the sticking problem, the thermal direct masters which use the alcohol-modified silicone oil, alkyl higher alcohol ester modified silicone oil and α-olefin modified silicone oil are superior. The thermal direct masters which use the polyether-modified silicone oil and the carboxy-modified are second to the above-mentioned three masters, in this order.

With respect to the dot-reproducibility in printed images, the thermal direct master using the alcohol-modified silicone oil is excellent. The thermal direct masters using polyether-modified silicone oil, α-olefin modified silicone oil, alkyl higher alcohol ester modified silicone oil and carboxy-modified silicone oil follow in this order.

The thermosensitive recording layer of the thermal direct master according to the present invention comprises the above-mentioned specific hydrophilic modified silicone oil, which prevents the thermal direct master from sticking to the thermal head in the course of master-making by thermal-printing. According to the present invention, excellent thermal direct masters can be obtained, which are superior to other conventional ones, with respect to the quality and resolution of images formed thereon.

Furthermore, when printing is performed using of the above-mentioned thermal direct master according to the present invention, high-quality clear images are produced without any deposition of the printing ink on the background of the sheets employed.

What is claimed is:

1. A thermal direct master for lithography comprising a water-resisting substrate and a thermosensitive recording layer formed thereon, which comprises as the main components an inorganic pigment, a binder agent, a thermofusible material and a hydrophilic modified silicone oil.

2. The thermal direct master for lithography as claimed in claim 1, wherein said hydrophilic modified silicone oil is selected from the group consisting of a carboxyl-modified silicone oil, an alkyl higher alcohol ester modified silicone oil, an alcohol-modified silicone oil, a polyether-modified silicone oil, and an α-olefin modified silicone oil.

3. The thermal direct master for lithography as claimed in claim 2, wherein said hydrophilic modified silicone oil is a carboxyl-modified silicone oil.

4. The thermal direct master for lithography as claimed in claim 2, wherein said hydrophilic modified silicone oil is an alkyl higher alcohol ester modified silicone oil.

5. The thermal direct master for lithography as claimed in claim 2, wherein said hydrophilic modified silicone oil is an alcohol-modified silicone oil.

6. The thermal direct master for lithography as claimed in claim 2, wherein said hydrophilic modified silicone oil is a polyether-modified silicone oil.

7. The thermal direct master for lithography as claimed in claim 2, wherein said hydrophilic modified silicone oil is an $\alpha$-olefin modified silicone oil.

8. The thermal direct master for lithography as claimed in claim 1, wherein the ratio by weight of said inorganic pigment to said binder agent is in the range of (0.5:1) to (10:1).

9. The thermal direct master for lithography as claimed in claim 1, wherein the amount of said thermofusible material contained in said thermosensitive recording layer is in the range of 0.1 to 20 wt. % of the total amount of said inorganic pigment and said binder agent.

10. The thermal direct master for lithography as claimed in claim 1, wherein the amount of said hydrophilic modified silicone oil is in the range of 0.1 to 20 wt. % of the total amount of said inorganic pigment and said binder agent.

* * * * *

UNITED STATES PATENT AND TRADEMARK OFFICE

CERTIFICATE OF CORRECTION

PATENT NO. : 4,974,513

DATED : December 4, 1990

INVENTOR(S) : Yamane et al.

It is certified that error appears in the above-identified patent and that said Letters Patent is hereby corrected as shown below:

In the Abstract, line 9, "eseter" should read --ester--

Column 1, line 7-8 "ther-malprinting." should read

--thermal-printing.--

Column 2, line 31, "c-olefin" should read

--a-olefin--

UNITED STATES PATENT AND TRADEMARK OFFICE

CERTIFICATE OF CORRECTION

PATENT NO. : 4,974,513

DATED : December 4, 1990

INVENTOR(S) : Yamane et al.

It is certified that error appears in the above-identified patent and that said Letters Patent is hereby corrected as shown below:

Column 3, line 21, "be employed. For example" should read --be employed. (start new paragraph with) For example--

Column 4, line 56, "a-olefion" should read --a-olefin--

Column 8, line 52, "carboxymodified" should read --carboxy-modified--

Signed and Sealed this

First Day of September, 1992

*Attest:*

*Attesting Officer*

DOUGLAS B. COMER

*Acting Commissioner of Patents and Trademarks*